US009051717B2

(12) United States Patent
Hodges et al.

(10) Patent No.: US 9,051,717 B2
(45) Date of Patent: Jun. 9, 2015

(54) MATERIAL HANDLING MACHINE

(75) Inventors: Peter H. Hodges, Peoria, IL (US); Jeffrey E. Jensen, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 691 days.

(21) Appl. No.: 13/249,728

(22) Filed: Sep. 30, 2011

(65) Prior Publication Data

US 2013/0084155 A1 Apr. 4, 2013

(51) Int. Cl.

| | |
|---|---|
| ***E02F 9/08*** | (2006.01) |
| ***E02F 3/352*** | (2006.01) |
| ***E02F 3/348*** | (2006.01) |
| ***E02F 9/20*** | (2006.01) |

(52) U.S. Cl.

CPC ..... *E02F 3/352* (2013.01); *E02F 3/3486* (2013.01); *E02F 9/205* (2013.01)

(58) Field of Classification Search

CPC ..... E02F 3/34; E02F 3/3402; E02F 3/3405; E02F 3/3408; E02F 3/3411; E02F 3/3414; E02F 3/342; E02F 3/3486; E02F 3/352; E02F 3/369; E02F 3/384; E02F 3/386

USPC ..... 37/412, 431, 432, 435, 437, 441, 442, 37/444; 414/399, 409, 420, 565, 584, 685, 414/686, 696, 718, 728, 742

See application file for complete search history.

(56) References Cited

U.S. PATENT DOCUMENTS

| | | | |
|---|---|---|---|
| 1,435,920 | A | 11/1922 | Greenleaf |
| 1,442,117 | A | 1/1923 | Billings et al. |
| 1,444,056 | A | 2/1923 | Billings et al. |
| 2,398,859 | A | 4/1946 | Ruddock |
| 2,427,968 | A | 9/1947 | Hoover |
| 3,090,511 | A | 5/1963 | Denham |
| 3,203,564 | A | 8/1965 | Brekelbaum |
| 3,472,405 | A | 10/1969 | Bowman et al. |
| 3,765,554 | A | 10/1973 | Morrison |
| 4,105,131 | A | 8/1978 | Broderick |
| 4,505,632 | A | 3/1985 | Quenzi |
| 5,468,120 | A | 11/1995 | Krob |
| 6,846,152 | B2 | 1/2005 | Mikrut |

FOREIGN PATENT DOCUMENTS

| | | |
|---|---|---|
| DE | 342039 | 10/1921 |
| FR | 895195 | 1/1945 |
| ZA | 970895 | 10/1997 |

*Primary Examiner* — Saul Rodriguez
*Assistant Examiner* — Brendan Tighe
(74) *Attorney, Agent, or Firm* — BakerHostetler

(57) ABSTRACT

A material handling machine includes a linkage assembly connected to a machine frame of the material handling machine. The linkage assembly configured to transport material from a front side of the machine frame to a rear side of the machine frame. The linkage assembly includes a first and a second guide rails associated with the machine frame. The linkage assembly further includes a first boom and a second boom having one end pivotally connected to the first guide rail and the second guide rails. A first and a second lift mechanism are pivotally connected to the first boom and second boom, respectively.

9 Claims, 8 Drawing Sheets

MATERIAL HANDLING MACHINE

TECHNICAL FIELD

The present disclosure relates to material handling machines and, more particularly to a material handling machine for lifting and dumping material.

BACKGROUND

Material loading into haul trucks typically involves excavators, shovels, wheel loaders, or similar material handling machines. The loading pattern of excavators and shovels typically involves rotations about two axes: horizontal for digging, vertical for movement of material to the receiving location (e.g., a haul truck). Wheel loaders typically engage in a "Y" movement for loading; this also is a rotation about a vertical axis.

Various material handling machines systems are well known in the art, for example, U.S. Pat. No. 6,846,152 discloses an overshot loader for autonomous operation. The loader includes ground engaging members, a machine frame attached to ground engaging members, and having a longitudinal direction from a dig end of the loader to a dump end of the loader, and a linkage assembly movably connected to and located at least partially within a longitudinal center portion of the machine frame and aligned with a transverse center of the machine frame. The linkage assembly is configured to autonomously transport a material from the dig end of the loader to the dump end of the loader, while the orientation of the linkage assembly remains substantially aligned in the longitudinal direction.

Conventional techniques of implementing material handling machines have not been effective. It is therefore desirable to provide, among other things, an improved material handling machine.

SUMMARY

In one aspect, the present disclosure provides a material handling machine having a set of ground engaging members, a machine frame and a linkage assembly. The machine frame is connected to the set of ground engaging members. The machine frame includes a first side-wall and a second side-wall opposite to the first side-wall. The linkage assembly is connected to the machine frame. The linkage assembly is configured to transport material from a front side of the machine frame to a rear side of the machine frame. The linkage assembly includes a first guide rail associated with the first side-wall, a second guide rail associated with the second side-wall and a first boom having a first end pivotally connected to the first guide rail and a second end pivotally connected to a loader bucket. The first boom is configured to slide along the first guide rail. A first lift mechanism is pivotally connected to the first boom. The linkage assembly further includes a second boom having a first end pivotally connected to the second guide rail and a second end pivotally connected to the loader bucket. The second boom is configured to slide along the second guide rail.

Other features and aspects of present disclosure will be apparent from the following description and the accompanying drawings.

DETAILED DESCRIPTION

Figure 1:
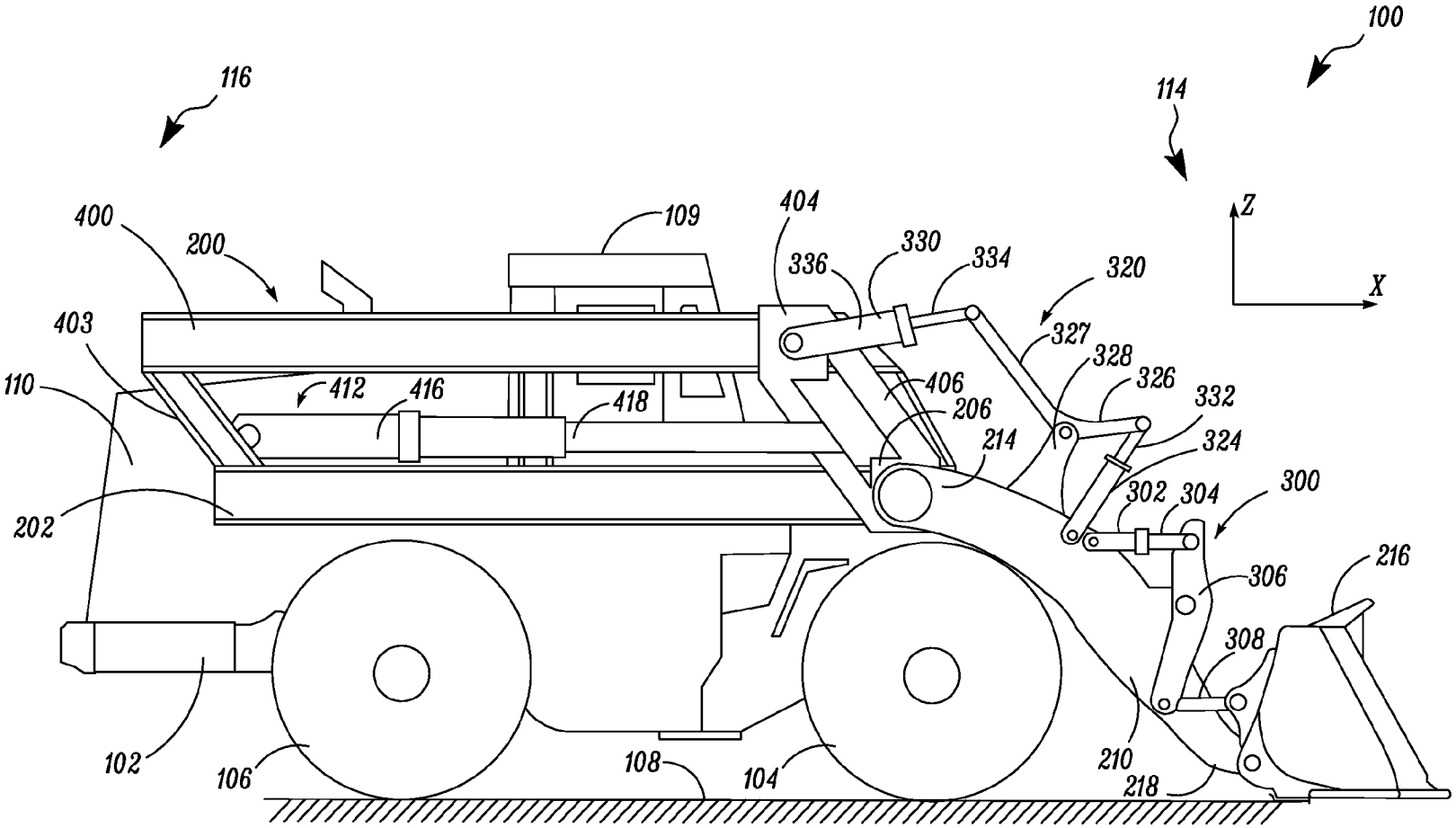
FIG. 1 is a first side view of a material handling machine, according to an aspect of the present disclosure.
Figure 2:
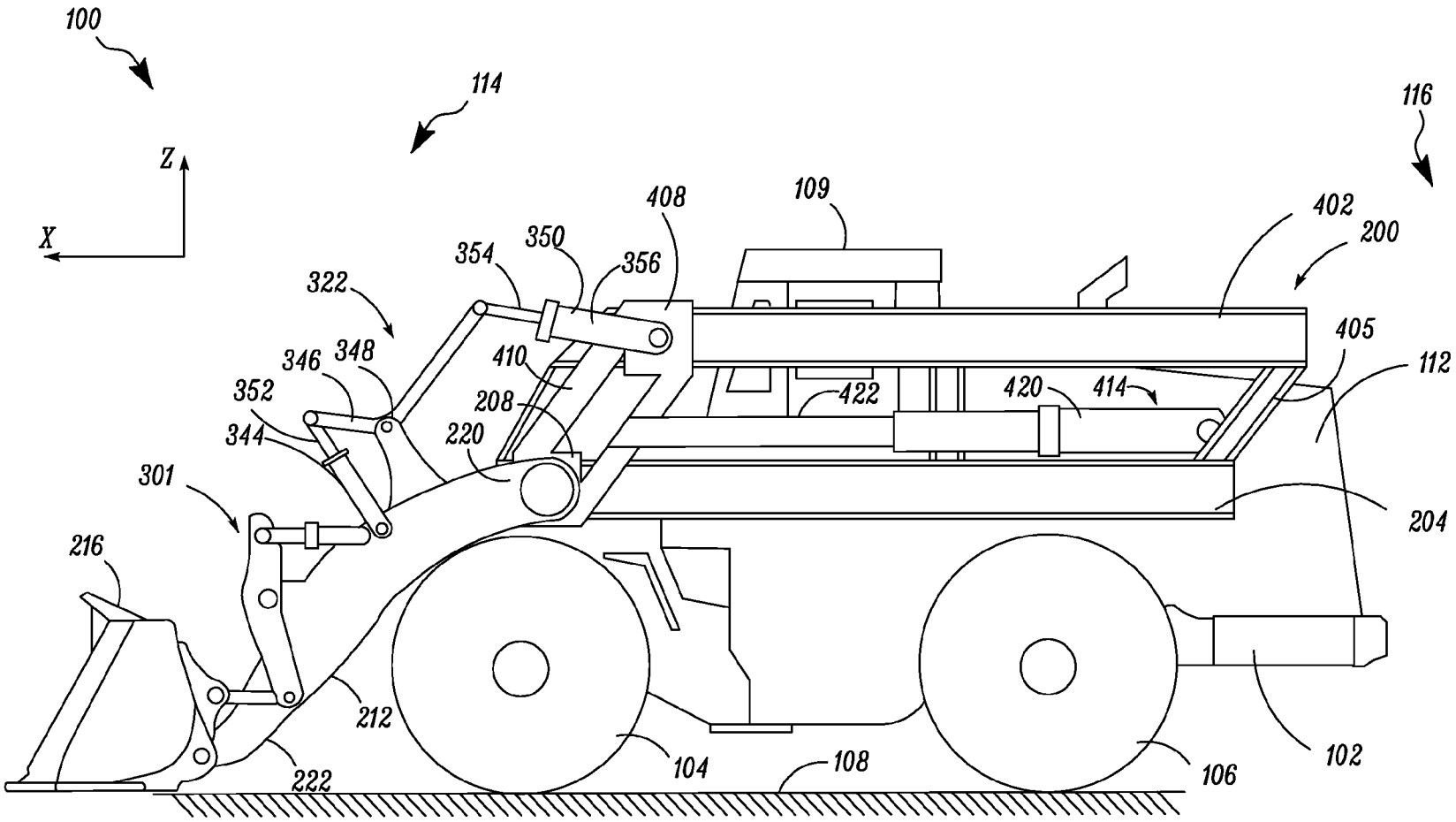
FIG. 2 is a second side view of the material handling machine shown in FIG. 1.

FIGS. 1 and 2 show a first side view and a second side view respectively, of a material handling machine 100 in an X-Z plane, according to an aspect of the present disclosure. The material handling machine 100 may include a tracked or a wheeled vehicle, for example, but not limited to, a wheel loader, a backhoe loader, an industrial loader, a skidder, a track type tractor, an excavator, a dozer, a tractor, used for lifting and/or handling of material. In an embodiment, the material handling machine 100 may embody a wheel loader which may be employed in various areas such as construction and mining for digging, scooping, lifting, and emptying the material.

The material handling machine 100 includes a machine frame 102, and a set of ground engaging members, such as front wheels 104 and rear wheels 106. The set of ground engaging members 104, 106 support the material handling machine 100 on a ground surface 108. The material handling machine 100 may further include other components, such as an internal combustion engine (not shown), an exhaust system (not shown) and the like, which may be supported by the machine frame 102. Further, an operator compartment 109 may be provided, which contains one or more controllers to control the operations of the material handling machine 100. In an alternative embodiment, the material handling machine 100 may be designed to work autonomously, and an operator may be present at a remote location.

As shown in FIGS. 1 and 2, the machine frame 102 may include a first side-wall 110, a second side-wall 112 opposite to the first side-wall 110, a front side 114, and a rear side 116 opposite to the front side 114. A linkage assembly 200 may be connected to the machine frame 102. The linkage assembly 200 may be configured to transport material from the front side 114 of the machine frame 102 to the rear side 116 of the machine frame 102.

As shown in FIG. 1, the linkage assembly 200 includes a first guide rail 202. The first guide rail 202 may be associated with the first side-wall 110. The first guide rail 202 may be in the form of a channel having an elongated groove, extending horizontally along the first side-wall 110. In an embodiment, the elongated groove of the first guide rail 202 may have a dovetail shaped cross-section (not shown). Alternatively, the elongated groove of the first guide rail 202 may have any other cross-section, such as, but not limited to, a trapezoidal cross-section, a rectangular cross-section, and a semi-circular cross-section. In an embodiment, the first guide rail 202 may be integrally formed with the first side-wall 110. Alternatively, the first guide rail 202 may be joined to the first side-wall 110 by welding or any other joining process known in the art. Further, as shown in FIG. 2, the linkage assembly 200 includes a second guide rail 204 may be associated with the second side-wall 112. The second guide rail 204 may be also in the form of a channel having an elongated groove, extending horizontally along the second side-wall 112. The second guide rail 204 may be structurally similar to the first guide rail 202.

Referring back to FIG. 1, a first slider 206 is slidably associated with the first guide rail 202. A portion of the first slider 206 may have a cross-section complementary to the cross-section of the elongated groove of the first guide rail 202, enabling the first slider 206 to form a prismatic joint with the first guide rail 202 and configured to slide along it. Alternatively, the first slider 206 may be provided with wheels or rollers configured to slide along the first guide rail 202. Likewise, a second slider 208 is slidably associated with the second guide rail 204 (see FIG. 2). A portion of the second slider 208 may have a cross-section complementary to the cross-section of the elongated groove of the second guide rail 204, enabling the second slider 208 to form a prismatic joint with the second guide rail 204 and configured to slide along it.

As shown in FIG. 1, the linkage assembly 200 further includes a first boom 210. The first boom 210 includes a first end 214 and a second end 218 distal from the first end 214. The first end 214 is connected to the first slider 206 which slides on the first guide rail 202 and the second end 218 is pivotally connected to a loader bucket 216. In an embodiment, the first end 214 of the first boom 210 may be pivotally connected to the first slider 206 associated with the first guide rail 202. Further, as shown in FIG. 2, the linkage assembly 200 includes a second boom 212. The second boom 212 is structurally similar to the first boom 210 and also includes a first end 220 and a second end 222 distal from the first end 220. The first end 220 is connected to the second guide rail 204 and the second end 222 is connected to the loader bucket 216. In an embodiment, the first end 220 of second boom 212 may also be pivotally connected to the second slider 208 associated with the second guide rail 204.

In an embodiment, the loader bucket 216 may be configured to move pivotally, relative to the first boom 210 and the second boom 212. The first boom 210 and the second boom 212 are rigidly transversely (Y direction) connected so that they simultaneously pivotally rotate about pin joints on the first slider 206 and the second slider 208. A tilt assembly 300 is provided to enable pivotal movement of the loader bucket 216 with respect to the first boom 210 and a tilt assembly 301 is provided to enable pivotal movement of the loader bucket 216 with respect to the second boom 212. As shown in FIG. 1, the tilt assembly 300 may include a cylinder 302 connected to the first boom 210. A piston 304 of the tilt assembly 300 is telescopically received within the cylinder 302 and is configured to move, hydraulically or pneumatically, with respect to the cylinder 302. Further, a control arm 306 connects the piston 304 and the loader bucket 216. The control arm 306 is configured to tilt the loader bucket 216, through a connecting link 308, with respect to the first boom 210 with the telescopic movement of the piston 304. In alternative embodiments, the piston 304 may be directly connected to the loader bucket 216, and the telescopic movement of the piston 304 may tilt the loader bucket 216 with respect to the first boom 210. The tilt assembly 301 may be similar to the tilt assembly 300 and therefore for the sake of brevity, the description of the same is omitted. In other embodiments of the present disclosure, a gear train actuator or a rotary actuator may be employed in place of the tilt assemblies 300 and 301 without deviating from the scope of the present disclosure. In an embodiment the operation of the tilt assembly 300 and the tilt assembly 301 are configured to move simultaneously. The tilt assembly 300 and the tilt assembly 301 may be connected by a connecting link (not shown). Alternatively, the loader bucket 216 connected to both of the tilt assembly 300 and the tilt assembly 301 acts as the connecting link.

Referring back to FIG. 1, the linkage assembly 200 furthermore includes a first lift mechanism 320. The first lift mechanism 320 is pivotally connected to the first boom 210. The first lift mechanism 320 includes a first auxiliary cylinder 324, a first crank 326, a first arm 328, and a first lift cylinder 330. The first auxiliary cylinder 324 is pivotally connected to the first boom 210 and a piston 332 of the first auxiliary cylinder 324 is pivotally connected to a first end of the first crank 326. In an embodiment, the first crank 326 has a first leg and a second leg forming an L-shaped configuration. However, in other embodiments of the present disclosure, the first crank 326 may have a curved shape or a planer shape etc. An intermediate point of the first crank 326 is pivotally connected to the first arm 328, forming a revolute joint. The first arm 328 is rigidly affixed to the first boom 210. A second end of the first crank 326 is pivotally connected to a piston 334 of the first lift cylinder 330. The piston 334 is configured to be telescopically received within a first lift cylinder body 336 of the first lift cylinder 330. The movement of the piston 334 may be caused hydraulically or pneumatically, and such movement of the piston 334 may tilt the first crank 326, which may tilt the first boom 210 about the first slider 206. With the first auxiliary cylinder 324 held at a fixed length, the first lift cylinder 330, an arm 327 of the first crank 326, the first boom 210, and the assembly (the first slider 206, the third slider 404, and the first intermediate link 406) form a 4-bar linkage, and actuation of the first lift cylinder 330 causes the first boom 210 to pivotally rotate about a pin joint mounted on the first slider 206.

Referring to FIG. 2, the linkage assembly 200 also includes a second lift mechanism 322 pivotally connected to the second boom 212. The second lift mechanism 322 includes a second auxiliary cylinder 344, a second crank 346, a second arm 348, and a second lift cylinder 350. The second auxiliary cylinder 344 is pivotally connected to the second boom 212 and a piston 352 of the second auxiliary cylinder 344 is pivotally connected a first end of to the second crank 346. In an embodiment, the second crank 346 has a first leg joined to a second leg. An intermediate point of the second crank 346 is pivotally connected to the second arm 348 is rigidly affixed to the second boom 212. A second end of the second crank 346 is pivotally connected to a piston 354 of the second lift cylinder 350. The piston 354 of the second lift cylinder 350 is configured to be telescopically received within a second lift cylinder body 356 thereby tilting the second crank 346. The movement of the piston 334 in conjunction with the movement of the piston 354 may cause tilting of the first boom 210 along with the second boom 212 about the first slider 206 and the second slider 208, respectively. In alternative embodiments of the present disclosure, each of the first lift mechanism 320 and the second lift mechanism 322 may be replaced by any other linkage/cylinder mechanism, a gear train mechanism or a rotary actuator mechanism.

In an embodiment, a third guide rail 400 and a fourth guide rail 402 are provided on the first side-wall 110 and the second side-wall 112, respectively (see FIGS. 1 and 2). The third guide rail 400 and the fourth guide rail 402 may also be in the form of an elongated grooved member, extending horizontally on the first side-wall 110 and the second side-wall 112, respectively. In an embodiment, the third guide rail 400 may run parallel to the first guide rail 202, and the fourth guide rail 402 may run parallel to the second guide rail 204. In an embodiment, each of the third guide rail 400 and the fourth guide rail 402 may have an elongated groove of a dovetail shaped cross-section. Alternatively, the elongated groove of the third guide rail 400 and the fourth guide rail 402 may have any other cross-section, such as a trapezoidal cross-section, a rectangular cross-section, a semi-circular cross-section or the like. The third guide rail 400 and the fourth guide rail 402 may be integral to the first side-wall 110 and the second side-wall 112, respectively. Alternatively, the third guide rail 400 and the fourth guide rail 402 may be joined to the first side-wall 110 and the second side-wall 112, respectively by welding or any other joining process known in the art. In an embodiment, the structural members 403, which rigidly join the first guide rail 202 and the third guide rail 400, may be provided to hold together the first guide rail 202 and the third guide rail 400. The structural members 403 may also be joined to the first side-wall 110. Optionally, the structural members 403, and rails (the first guide rail 202, the second guide rail 204, the third guide rail 400, and the fourth guide rail 402) may be cross braced or trussed (not shown) to reduce lateral vibrations. Similarly, structural members 405 may be provided to hold together the second guide rail 204 and the fourth guide rail 402. See FIG. 2, the structural members 405 may be joined to the second side-wall 112. Optionally, the structural members 405 may be cross braced or trussed (not shown) to reduce lateral vibrations.

As shown in FIG. 1, a third slider 404 is associated with the third guide rail 400. In an embodiment, a portion of the third slider 404 may have a cross-section complimentary to the cross-section of the elongated groove on the third guide rail 400. The third slider 404 is configured to slidably move along the third guide rail 400. The first lift mechanism 320 is connected to the third slider 404. Particularly, an end portion of the first lift cylinder body 336 of the first lift mechanism 320 is pivotally connected to the third slider 404. Therefore, the first lift mechanism 320 moves with the movement of the third slider 404. Further, the third slider 404 is fixedly connected to the first slider 206 through a first intermediate link 406, such that the third slider 404 remains fixed with respect to the first slider 206.

As shown in FIG. 2, a fourth slider 408 is associated with the fourth guide rail 402. A portion of the fourth slider 408 may have a cross-section complimentary to the cross-section of the elongated groove on the fourth guide rail 402. The fourth slider 408 is configured to move along the fourth guide rail 402. The second lift mechanism 322 is connected to the fourth slider 408. Particularly, an end portion of the second lift cylinder body 356 is pivotally connected to the fourth slider 408. Further, the fourth slider 408 is fixedly connected to the second slider 208 through a second intermediate link 410, such that the fourth slider 408 remains fixed with respect to the second slider 208.

In an embodiment, a first slide actuator 412 is disposed on the first side-wall 110 to cause movement of the first slider 206 and the third slider 404. Further, a second slide actuator 414 is disposed on the second side-wall 112 to cause movement of the second slider 208 and the fourth slider 408. A body portion 416 of the first slide actuator 412 is fixedly connected by the first side-wall 110 while a telescoping arm 418 of the first slide actuator 412 is connected to the first intermediate link 406. Alternatively, the body portion 416 of the first slide actuator 412 is hingedly connected by the first side-wall 110. Further, a body portion 420 of the second slide actuator 414 is fixedly connected by the second side-wall 112 while a telescoping arm 422 of the second slide actuator 414 is connected to the second intermediate link 410. Alternatively, the body portion 420 of the second slide actuator 414 is hingedly connected by the second side-wall 112. In alternative embodiments of the present disclosure, the first slide actuator 412 and the second slide actuator 414 may be a hydraulic linear actuator system, a cable-sheave system, an electric linear actuator system, or a rack-and-pinion system. The actions of the first slide actuator 412, the second slide actuator 414; the second lift cylinder 350; the first auxiliary cylinder 324, the second auxiliary cylinder 344 are coordinated by a suitable control algorithm such that the first lift mechanism 320, the second lift mechanism 322, and the linkage assembly 200 act in concert to lift and transport the loader bucket 216 from the front end 114 of the material handling machine 100 to the rear end 116 of the material handling machine 100.

Figure 5:
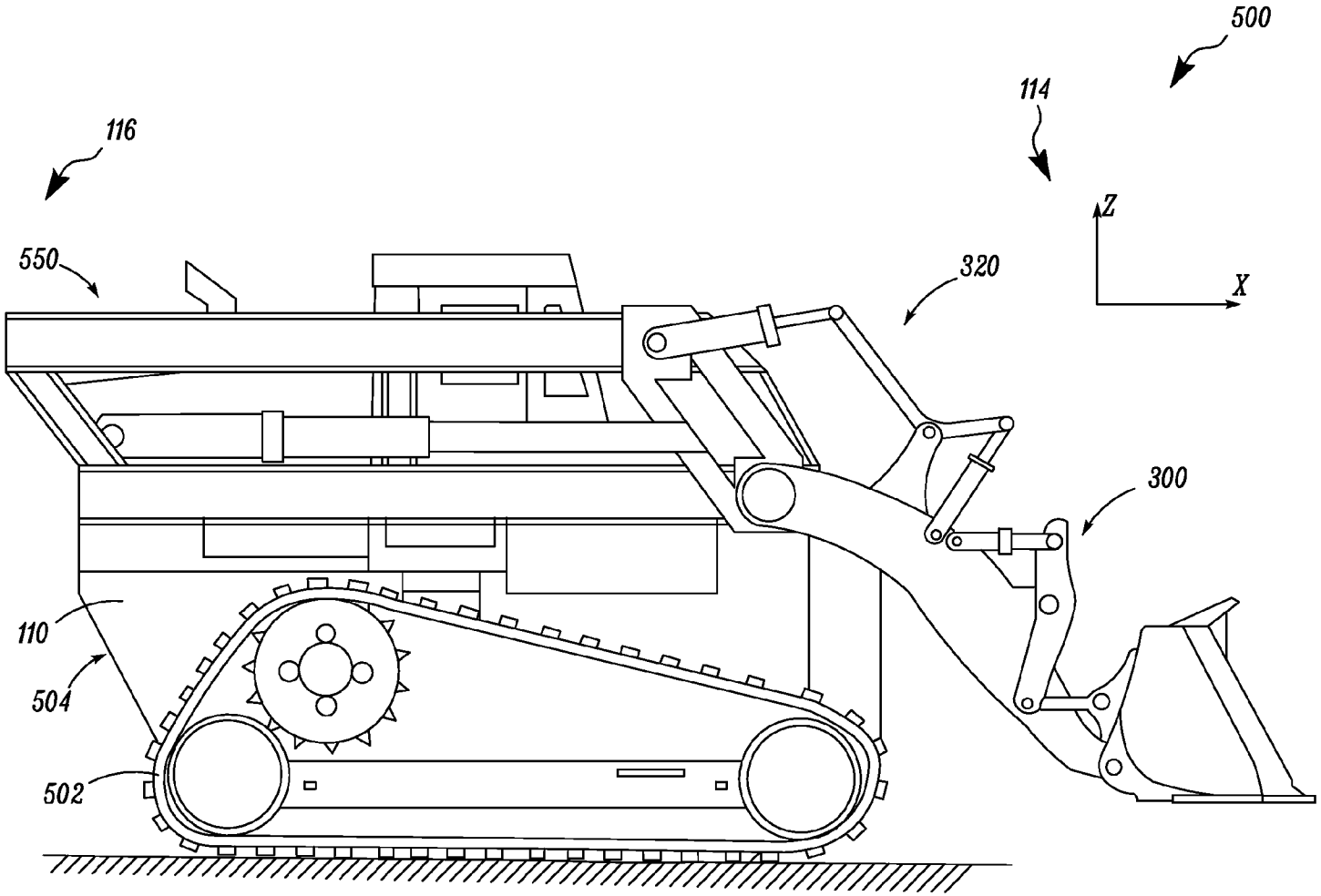
FIG. 5 is a side view of a material handling machine according to another aspect of the present disclosure.

Referring now to FIG. 5 which shows a first side view of a material handling machine 500, according to another aspect of the present disclosure. The material handling machine 500 embodies as a crawler tractor. The material handling machine 500 includes a machine frame similar to the machine frame 102 and a ground engaging members, such as a first track 502 and a second track (not shown). The machine frame 504 may include a first side-wall such as the first side wall 110, a second side-wall, such as the second side-wall 112 opposite to the first side-wall, a front side, and a rear side opposite to the front side. A linkage assembly 550 may be connected to the machine frame 504. The linkage assembly 550 may be configured to transport material from the front side 114 of the machine frame 504 to the rear side 116 of the machine frame 102. All the elements of the linkage assembly 550 may be structurally and functionally similar to the linkage assembly 200, therefore for the sake of brevity, the description has been omitted.

Figure 6:
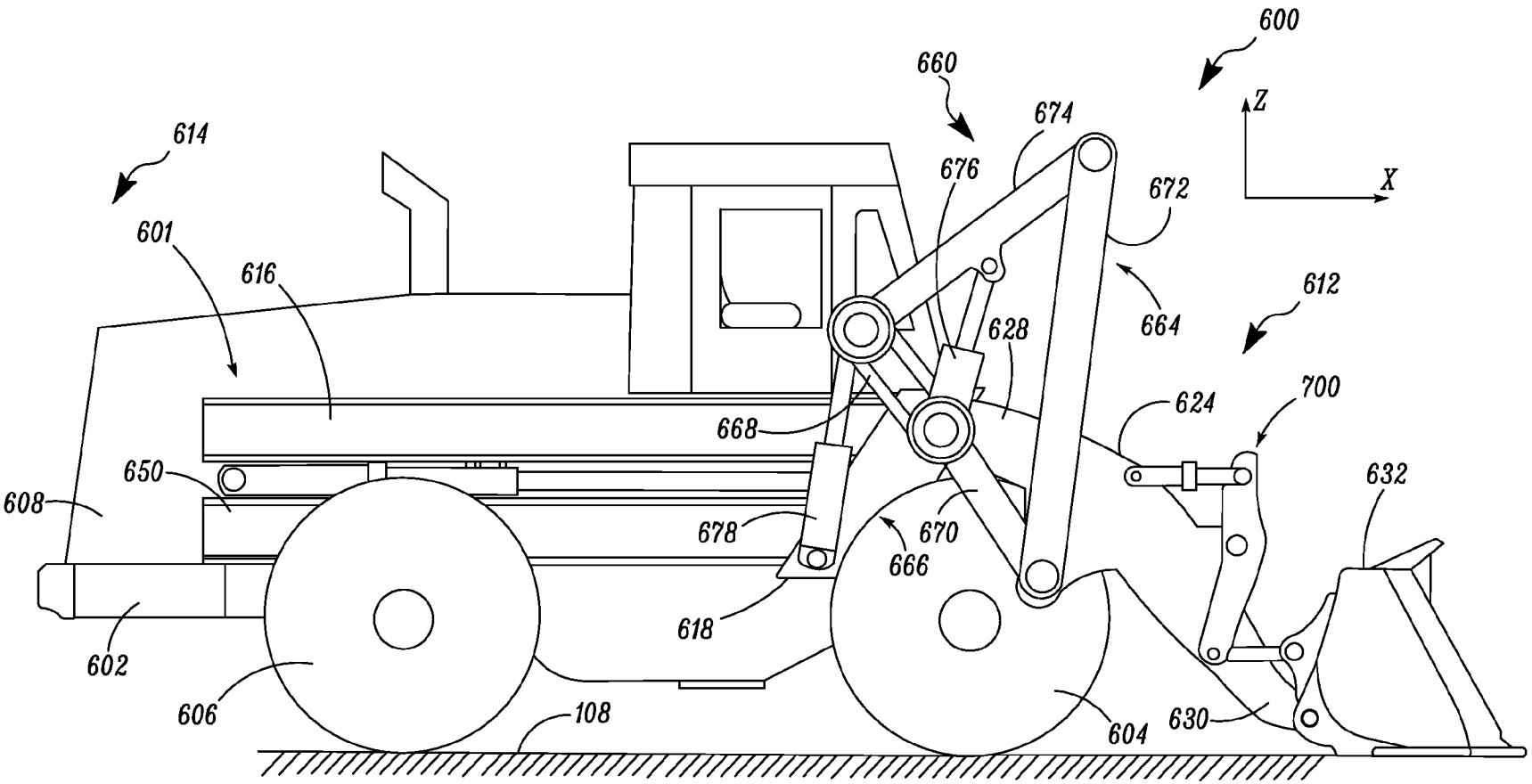
FIG. 6 is a first side view of a material handling machine according to yet another aspect of the present disclosure.
Figure 7:
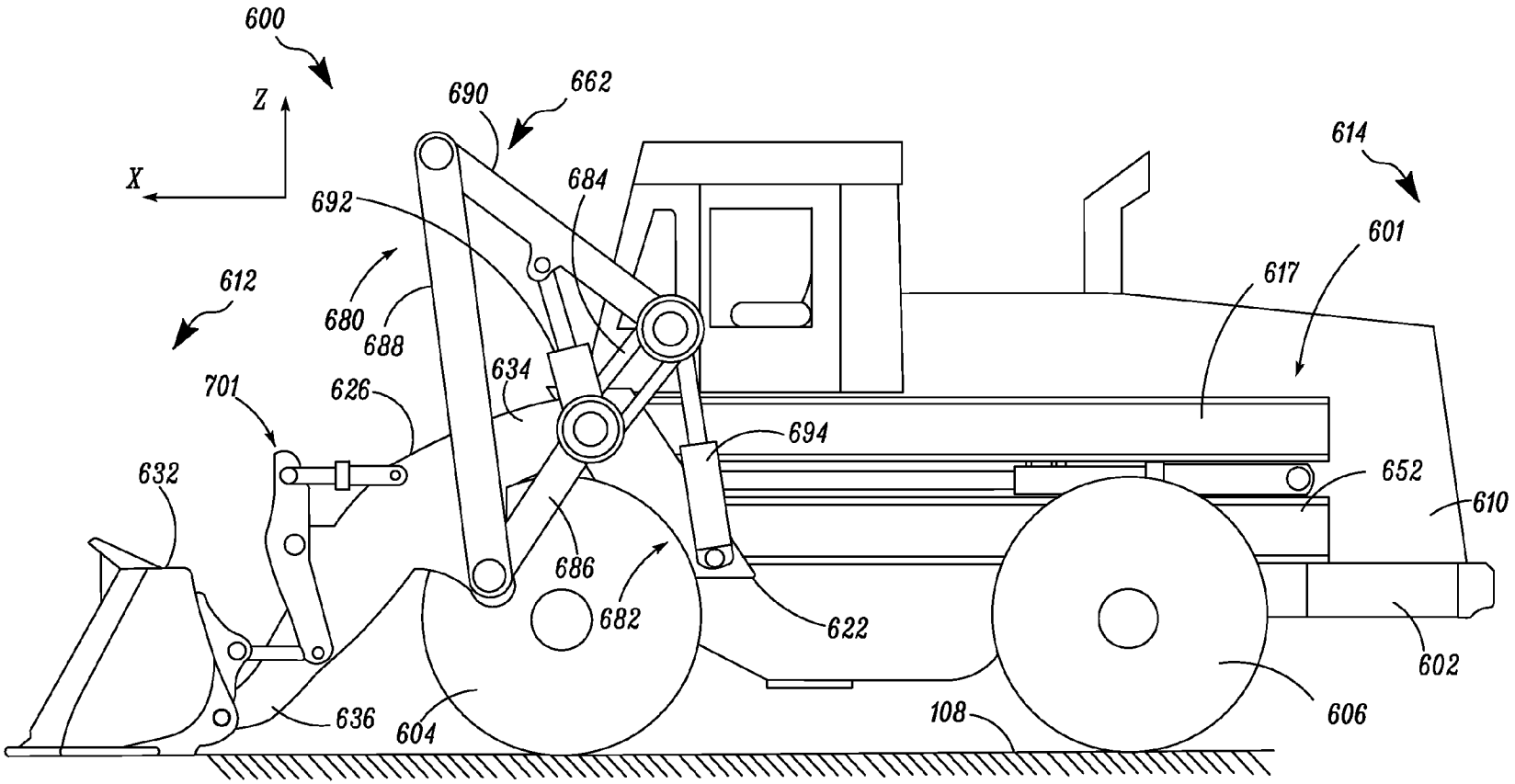
FIG. 7 is a second side view of the material handling machine shown in FIG. 6.

Referring now to FIGS. 6 and 7 which show a first side view and a second side view of a material handling machine 600 in X-Z plane, according to yet another embodiment of the present disclosure. The material handling machine 600 includes a machine frame 602, and a set of ground engaging members, such as front wheels 604 and rear wheels 606. The machine frame 602 is connected to the set of ground engaging members 604, 606. The set of ground engaging members 604, 606 support the material handling machine 600 on the ground surface 108.

The machine frame 602 may include a first side-wall 608, and a second side-wall 610 opposite to the first side-wall 608. A linkage assembly 601 may be connected to the machine frame 602. The linkage assembly 601 may be configured to transport material from a front side 612 of the machine frame 602 to a rear side 614 of the machine frame 602.

As shown in FIGS. 6 and 7, the linkage assembly 601 includes a first guide rail 616. The first guide rail 616 may be associated with the first side-wall 608. Like wise, the linkage assembly 601 includes a second guide rail 617 associated with the second side-wall 610. A first slider 618 is kinematically associated with the first guide rail 616. Further, a second slider 622 is kinematically associated with the second guide rail 617.

The linkage assembly 601 further includes a first boom 624 and a second boom 626. The first boom 624 includes a first end 628 and a second end 630 distal from the first end 628. The first end 628 of the first boom 624 is pivotally connected to the first slider 618. The second end 630 of the first boom 624 is pivotally connected to a loader bucket 632. The second boom 626, being structurally similar to the first boom 624 also includes a first end 634 and a second end 636 distal from the first end 634. The first end 634 is pivotally connected to the second slider 622. The second end 636 of the second boom 626 is also connected to the loader bucket 632. The loader bucket 632 may be configured to move pivotally, relative to the first boom 624 and the second boom 626. A tilt assembly 700 similar to the tilt assembly 300 (see FIGS. 1 and 2) is provided to enable pivotal movement of the loader bucket 632 with respect to the first boom 624. Further, a tilt assembly 701 similar to the tilt assembly 700 is provided to enable pivotal movement of the loader bucket 632 with respect to the second boom 626. The tilt assemblies 700 and 701 may be configured to move simultaneously. In an embodiment, the tilt assemblies 700 and 701 may be connected by a connecting link. Alternatively, the loader bucket 632 connected to both of the tilt assembly 700 and the tilt assembly 701 acts as the connecting link.

In an embodiment, a third guide rail 650 and a fourth guide rail 652 are provided on the first side-wall 608 and the second side-wall 610, respectively. The first slider 618 is also kinematically associated with the third guide rail 650. Therefore the first slider 618 is configured to simultaneously slide along the first guide rail 616 and the third guide rail 650. The first boom 624, being associated with the first slider 618 may also move with the movement of the first slider 618 along a longitudinal axis of the material handling machine 600. Likewise, the second slider 622 is kinematically associated with the fourth guide rail 652. Therefore the second slider 622 is configured to simultaneously slide along the second guide rail 617 and the fourth guide rail 652. The second boom 626, being associated with the second slider 622 may also move with the movement of the second slider 622 along the longitudinal axis of the material handling machine 600. It will be apparent to a person skilled in the art that both the first boom 624 and the second boom 626 are connected to the loader bucket 632, the sliding movement of the first boom 624 will effect equivalent sliding movement of the second boom 626 and vice versa.

Referring again to FIGS. 6 and 7, the linkage assembly 601 includes a first lift mechanism 660 and a second lift mechanism 662 opposite to the first lift mechanism 660. The first lift mechanism 660 is carried by the first slider 618 and the second lift mechanism 662 is carried by the second slider 622. In an embodiment, as shown in FIG. 6, the first lift mechanism 660 may include a first and a second four-bar linkage assembly 664, 666. The first four-bar linkage assembly 664 includes a base member 668, a follower arm 670, a link arm 672, and a crank 674. The follower arm 670 drives the first boom 624 through a revolute joint formed by the follower arm 670 and the link arm 672. The movement of the first boom 624 may be achieved by the crank 674 which is driven by a first lift hydraulic cylinder 676. The second four-bar linkage assembly 666 includes a first auxiliary hydraulic cylinder 678, the first slider 618, and the base member 668. The first auxiliary hydraulic cylinder 678 causes the base member 668 to rotate the first four-bar linkage assembly 664, when the first lift hydraulic cylinder 676 is fixed.

Referring now to FIG. 7, the second lift mechanism 662 may also include a third and a fourth four-bar linkage assembly 680 and 682. The third four-bar linkage assembly 680 includes a base member 684, a follower arm 686, a link arm 688, and a crank 690. The follower arm 686 drives the second boom 626 through a revolute joint formed by the follower arm 686 and the link arm 688. The movement of the second boom 626 may be achieved by the crank 690 which is driven by a second lift hydraulic cylinder 692. The fourth four-bar linkage assembly 682 includes a second auxiliary hydraulic cylinder 694, the second slider 622, and the base member 684. The second auxiliary hydraulic cylinder 694 causes the base member 684 to rotate the third four-bar linkage assembly 680, when the second lift hydraulic cylinder 692 is fixed. The first lift mechanism 660 and the second lift mechanism 662, and the slider (prismatic longitudinal transport) are controlled by a suitable algorithm such that they act in concert to dig, lift, and transport the loader bucket 216 from the front side 114 to the rear side 116 of the material handling machine 100.

Figure 8:
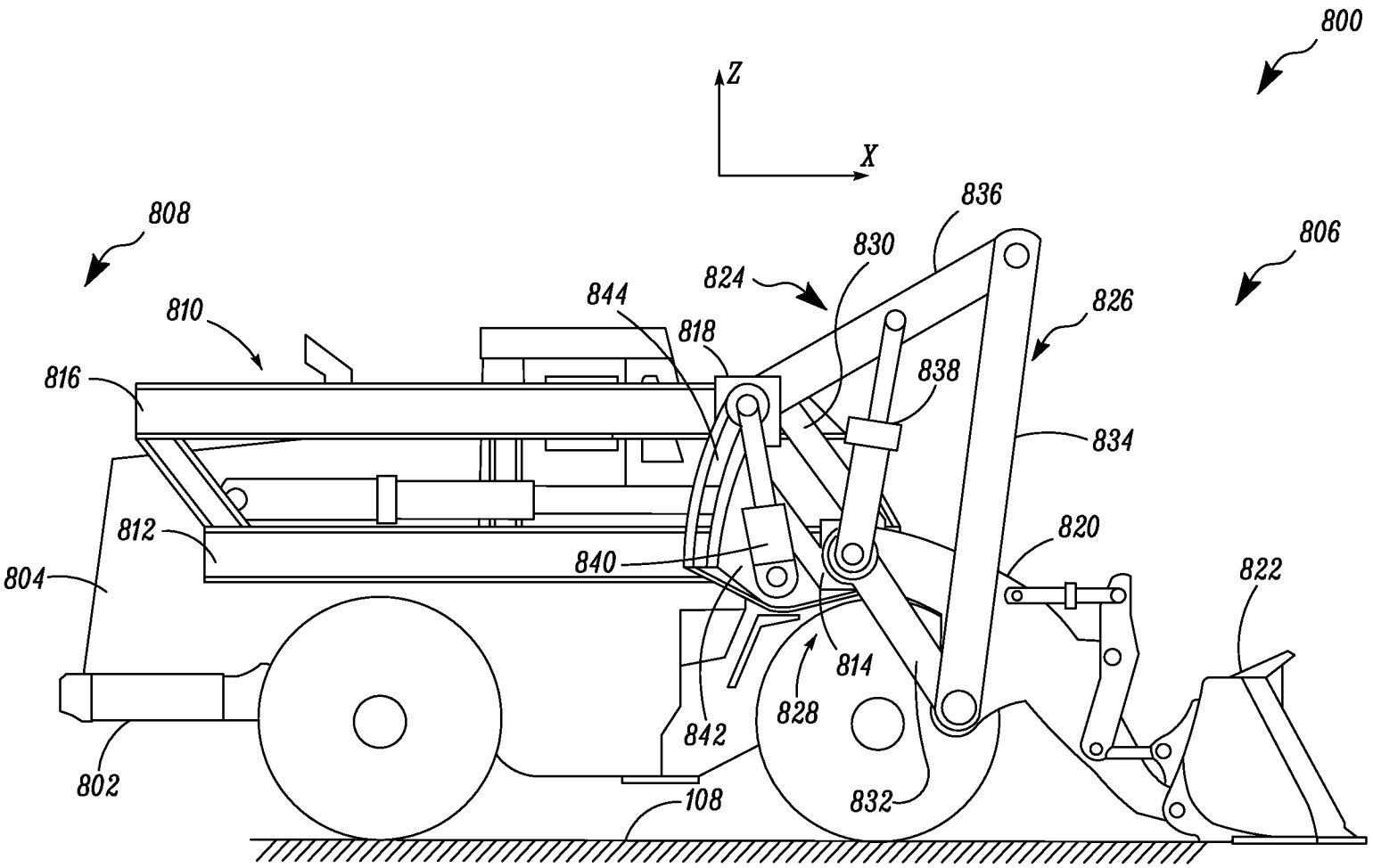
FIG. 8 is a side view of a material handling machine, according to yet another aspect of the preset disclosure.

Referring now to FIG. 8, which illustrates a side view of a material handling machine 800 in X-Z plane, according to yet another embodiment of the present disclosure. The material handling machine 800 includes a machine frame 802 having a first side-wall 804, a front side 806, and a rear side 808 opposite to the front side 806. A linkage assembly 810 may be connected to the machine frame 802.

The linkage assembly 810 includes a first guide rail 812 associated with the first side-wall 804. A first slider 814 is slidably associated with the first guide rail 812. Further, a second guide rail 816 is provided on the first side-wall 804. A second slider 818 is associated with the second guide rail 816. The material handling machine 800 further includes a first boom 820 and a loader bucket 822 connected to the first boom 820. The loader bucket 822 may be configured to move pivotally, relative to the first boom 820. It will be apparent to a person skilled in art that the material handling machine 800 include a second boom associated with a second side wall opposite to the first side-wall 804.

The linkage assembly 810 furthermore includes a first lift mechanism 824. In an embodiment, as shown in FIG. 8, the first lift mechanism 824 may include a first and a second four-bar linkage assembly 826, 828. The first four-bar linkage assembly 826 includes a base member 830, a follower arm 832, a link arm 834, and a crank 836. The follower arm 832 drives the first boom 820 through a revolute joint formed by the follower arm 832 and the link arm 834. The movement of the first boom 820 may be achieved by the actuating crank 836 which is driven by a first lift hydraulic cylinder 838. The second four-bar linkage assembly 828 includes a first auxiliary hydraulic cylinder 840, a second base member 842, and the base member 830. The second base member 842 is rigidly fixed to the first and second sliders 814 and 818. The first auxiliary hydraulic cylinder 840 causes the base member 830 to rotate the first four-bar linkage assembly 826, when the first lift hydraulic cylinder 838 is fixed. In an embodiment, a roller may be provided at a revolute joint formed by the base member 830 and the first auxiliary hydraulic cylinder 840. The roller may run in a track 844. Moreover, the second lift mechanism 662 may be provided on the second side-wall of the machine frame 802. The second lift mechanism 662 is parallel to the first lift mechanism 824.

INDUSTRIAL APPLICABILITY

As described above, the present disclosure provides a lift and sliding mechanism to transport a loader bucket from a front side to a rear side of a material handling machine. The rotation of the boom is actuated by a lift mechanism to dig, scoop, and lift the material. Slide actuators are provided to transport the material to the rear side of the material handling machine, for discharge to, for example, a truck or a conveyor. Further, to reduce the number of axes about which the material rotates and to reduce the entire machine movement of wheel loaders during loading, and thereby improve loading efficiency, the present disclosure proposes a prismatic joint transport system combined with a mechanism that affords larger boom rotation for a material handling machine such as a wheel loader.

During operation of the material handling machine 100, the first boom 210 and the second boom 212 move the loader bucket 216 for gathering the material from the ground surface 108. The material handling machine 100 of the present disclosure avoids any rotation of the first and the second boom 212 and 216 about a vertical axis for transporting material from the front side 114 to the rear side 116. In a first position, shown in FIG. 1, the linkage assembly 200 may lower the first boom 210 and the second boom 212 to the ground surface 108 such that the loader bucket 216 approaches the material e.g. material on the ground surface 108. Once the material is loaded on to the loader bucket 216, the first lift mechanism 320 and the second lift mechanism 322 move the first boom 210 and the second boom 212, respectively. Such movement of the first boom 210 and the second boom 212 lifts the loader bucket 216 along with the material contained therein.

Figure 3:
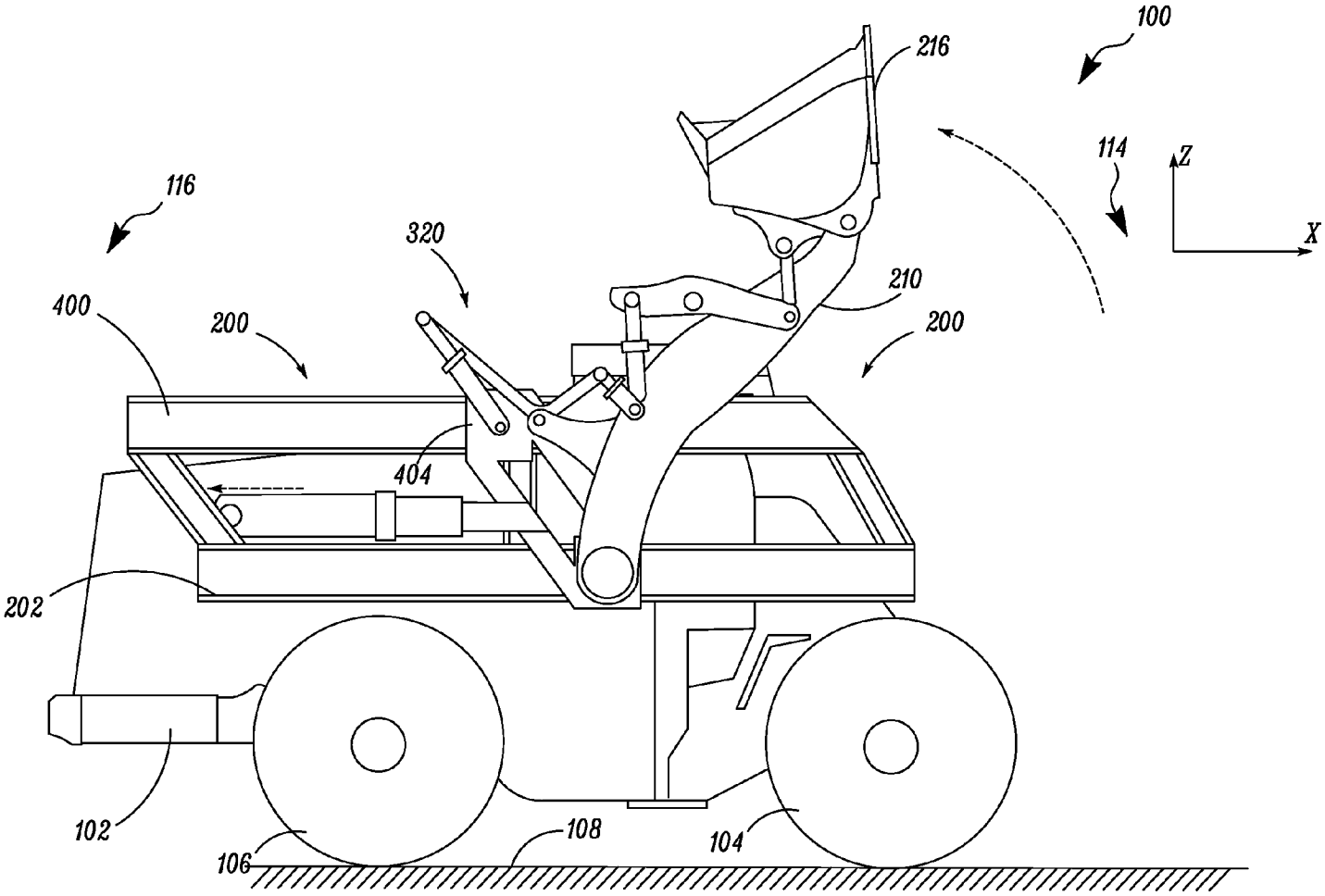
FIG. 3 is another view of the material handling machine shown in FIG. 1.

Further, the first slide actuator 412 and the second slide actuator 414 moves the first and second intermediate links 406 and 410 respectively, thereby moving the first boom 210 and the second boom 212. The first boom 210 and the second boom 212 move along the first guide rail 202 and the second guide rail 204 to reach an intermediate position shown in FIG. 3.

Figure 4:
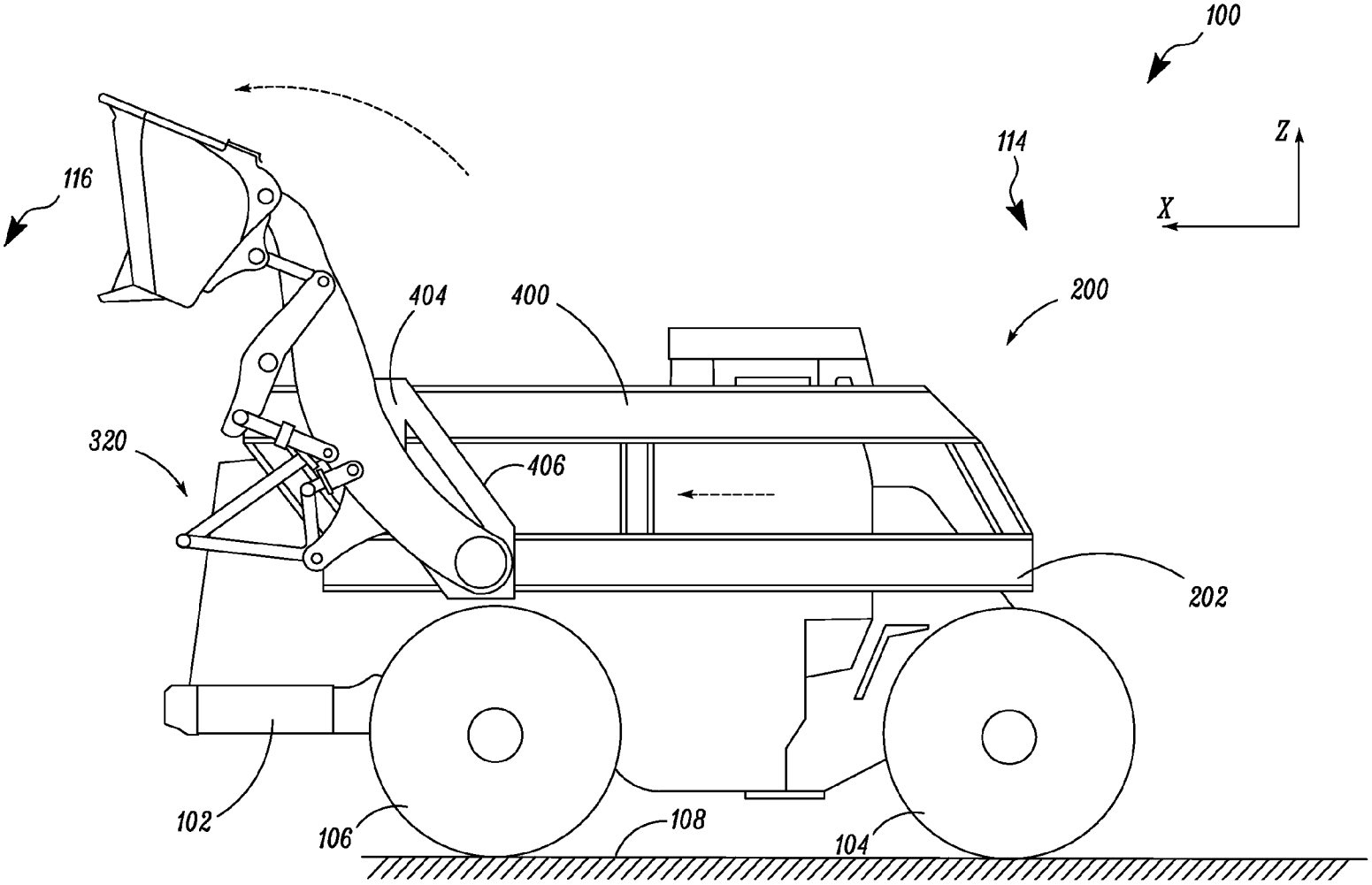
FIG. 4 is yet another view of the material handling machine shown in FIG. 1.

Subsequently, the first slide actuator 412 and the second slide actuator 414 further moves the first and the second intermediate links 406 and 410 to accordingly move the first boom 210 and the second boom 212. Further, the first lift mechanism 320 and the second lift mechanism 322 moves the first boom 210 and the second boom 212 to a dumping position, shown in FIG. 4. At the dumping position, the material contained in the loader bucket is dumped in to a haul truck, a container or a conveyer belt. Accordingly, in the material handling machine 100 of the present disclosure, the linkage assembly 200 increases loading efficiency.

Aspects of the present disclosure may also be applied to other vehicles, both wheeled and tracked. Although the embodiments of the present disclosure as described herein may be incorporated without departing from the scope of the following claims, it will be apparent to those skilled in the art that various modifications and variations can be made, for example the material handling machines 500, 600 and 800 as shown in FIGS. 5-8. Other embodiments will be apparent to those skilled in the art from consideration of the specification and practice of the disclosure. It is intended that the specification and examples be considered as exemplary only, with a true scope being indicated by the following claims and their equivalents.

What is claimed is:

1. A material handling machine comprising:

a set of ground engaging members;

a machine frame connected to the set of ground engaging members, the machine frame including a first side-wall and a second side-wall opposite to the first side-wall;

a linkage assembly connected to the machine frame, the linkage assembly configured to transport material from a front side of the machine frame to a rear side of the machine frame, the linkage assembly including, a first guide rail associated with the first side-wall, a second guide rail associated with the second side-wall, a first boom having a first end pivotally connected to a first slider, the first slider configured to move along the first guide rail, and a second end of the first boom pivotally connected to a loader bucket, a first lift mechanism pivotally connected to the first boom a second boom having a first end pivotally connected to a second slider, the second slider configured to move along the second guide rail, and a second end of the second boom pivotally connected to the loader bucket, and a second lift mechanism pivotally connected to the second boom;

a first slider pivotally connected to the first end of the first boom and configured to move along the first guide rail;

a third guide rail provided on the first side-wall and a third slider configured to move along the third guide rail, wherein the first lift mechanism is pivotally connected to the third slider;

a first intermediate link connecting the first slider and the third slider; and a first slide actuator disposed on the first side-wall, the first slide actuator directly connected to the first intermediate link.

2. The material handling machine of claim 1 further including a fourth guide rail provided on the second side-wall and a fourth slider configured to move along the fourth guide rail, wherein the second lift mechanism is pivotally connected to the fourth slider.

3. The material handling machine of claim 2 further including a second intermediate link to connect the second slider and the fourth slider.

4. The material handling machine of claim 3 further including a second slide actuator disposed on the second side-wall, the second slide actuator connected to the second intermediate link.

5. A linkage assembly for a material handling machine having a set of ground engaging members and a machine frame connected to the set of ground engaging members, the linkage assembly comprising:

a first guide rail associated with a first side-wall of the machine frame;

a second guide rail associated with a second side-wall of the machine frame;

a first boom having a first end pivotally connected to a first slider, the first slider configured to move along the first guide rail, and a second end of the first boom pivotally connected to a loader bucket;

a first lift mechanism pivotally connected to the first boom;

a second boom having a first end pivotally connected to a second slider, the second slider configured to move along the second guide rail, and a second end of the second boom pivotally connected to the loader bucket;

a second lift mechanism pivotally connected to the second boom, wherein the linkage assembly is configured to cause the loader bucket to move from a front side of the machine frame to a rear side of the machine frame, while the loader bucket is elevated above the machine frame;

a third guide rail provided on the first side-wall and a third slider configured to move along the third guide rail, wherein the first lift mechanism is pivotally connected to the third slider;

a first intermediate link connecting the first slider and the third slider; and a first slide actuator disposed on the first side-wall, the first slide actuator directly connected to the first intermediate link.

6. The material handling machine of claim 1 further including a first tilt assembly connected to the first boom and the loader bucket and configured to enable pivotal movement of the loader bucket with respect to the first boom.

7. The material handling machine of claim 1 further including a second tilt assembly connected to the second boom and the loader bucket and configured to enable pivotal movement of the loader bucket with respect to the second boom.

8. The material handling machine of claim 5 further including a tilt assembly connected to the first boom and the loader bucket and configured to enable pivotal movement of the loader bucket with respect to the first boom.

9. The material handling machine of claim 4 further including a second tilt assembly connected to the second boom and the loader bucket and configured to enable pivotal movement of the loader bucket with respect to the second boom.

* * * * *